United States Patent [19]

Evans

[11] Patent Number: 4,505,615

[45] Date of Patent: Mar. 19, 1985

[54] METHOD OF SUPPORTING A SHALLOW WATER DRILLING BARGE

[75] Inventor: Darrell L. Evans, Spring, Tex.

[73] Assignee: Atlantic Pacific Marine Corporation, Houston, Tex.

[21] Appl. No.: 405,861

[22] Filed: Aug. 6, 1982

Related U.S. Application Data

[63] Continuation-in-part of Ser. No. 349,459, Feb. 12, 1982, Pat. No. 4,456,404.

[51] Int. Cl.[3] ..... E02B 17/04

[52] U.S. Cl. ..... 405/196; 405/203; 405/205

[58] Field of Search ..... 405/196, 203–209

[56] References Cited

U.S. PATENT DOCUMENTS

| | | | |
|---|---|---|---|
| 2,385,341 | 9/1945 | Bayley | 405/205 X |
| 2,892,314 | 6/1959 | Hornsby et al. | 405/196 |
| 2,942,425 | 6/1960 | DeLong et al. | 405/196 |
| 3,001,594 | 9/1961 | Suderow | 175/9 |
| 3,007,316 | 11/1961 | Higgins, Jr. . | |
| 3,477,235 | 11/1969 | Branham et al. . | |
| 3,575,005 | 4/1971 | Sumner . | |
| 3,727,414 | 4/1973 | Davies | 405/196 |
| 3,790,009 | 2/1974 | Hauber | 405/196 X |
| 3,946,684 | 3/1976 | Sumner . | |
| 3,999,396 | 12/1976 | Evans | 114/77 A |
| 4,040,265 | 8/1977 | Hellerman et al. | 405/212 |
| 4,103,503 | 8/1978 | Smith . | |

OTHER PUBLICATIONS

"Shallow Water Levelling Barge Proposed", *Drilling Contractor*, vol. 37, No. 11, Nov. 1981, pp. 57,60.

*Primary Examiner*—Dennis L. Taylor

*Attorney, Agent, or Firm*—Fitzpatrick, Cella, Harper & Scinto

[57] ABSTRACT

A shallow water drilling barge (46) is supported on a silty water bed (50) of low bearing capacity by providing a submersible platform (74) such as the platform of a jackup drydock (40) with jacking legs (42), floating the jackup drydock into position, ballasting it until it rests on the bottom, floating the jackup drydock into position, ballasting it until it rests on the bottom, floating the drilling barge into position over the platform and floating the barge so that it comes to rest on the platform, with the weight of the barge and jackup drydock as so submerged being less than the load bearing capability of the underlying soil and then jacking down the legs of the jackup drydock to increase its load carrying capability.

8 Claims, 14 Drawing Figures

58
46
42
42
59
60
54
94
66
40
52
52
50
74
92
74
60
42
42
48
48

METHOD OF SUPPORTING A SHALLOW WATER DRILLING BARGE

CROSS REFERENCE TO RELATED APPLICATIONS

This is a continuation-in-part of copending application Ser. No. 349,459 filed Feb. 12, 1982, now U.S. Pat. No. 4,456,404 issued June 26, 1984.

BACKGROUND OF THE INVENTION

1. Field of the Invention

This invention relates to arrangements for supporting drilling barges and more particularly it concerns a novel method for securely positioning a shallow water drilling barge on an underwater bed of low bearing capacity.

2. Description of the Prior Art

Many oil deposits in the United States and in other countries have been found to be located in areas characterized by shallow water overlying a bed of silty soil having very low bearing capacity, e.g. less than 8,900 pounds per square foot (3,900 kg/m$^2$). The technique most widely used for drilling in these areas has been to float a drilling barge having shallow draft into position over the drilling site and then to flood the barge hull and allow it to settle onto the underlying soil. Sometimes the barge is "posted", that is, its deck containing the drilling materials and equipment is elevated above the hull so that when the hull is resting on the bottom, the deck and the materials and equipment carried on it will be maintained up above the water level.

Problems have been encountered where the soil under the water has low bearing capacity. Although the soil may be able to support the barge initially, it often is incapable of maintaining support as drilling progresses and the drill string extending down from the barge into the earth extends in length to impose a steadily increasing "hook load" on the barge. This hook load may eventually exceed the supporting capability of the soil, and the barge will no longer be stably supported but instead will begin to shift or sink.

One prior technique which has been used to overcome this problem of low soil bearing capacity involved the building up of a pad of suitable dense material, e.g. oyster shells, on the water bottom before the barge was brought to the site. The pad would provide a large surface area to reduce the unit pressure on the underlying soil. In many instances this technique is prohibitively expensive. Also, depending on the soil conditions, even the pad itself would gradually sink into the underlying soil.

It also has been proposed to provide a jackup barge to support the drilling barge during drilling operations. This technique, as described in *Drilling Contractor* Volume 37, No. 11, November, 1981 on pages 57 and 60, would involve the floating of a "shallow water jackup leveling barge" to the drilling site, jacking vertical legs down from the barge and into the underlying soil until the barge is lifted up out of the water, pinning the elevated barge to the legs and ballasting the barge with water to drive the legs down into the soil. The barge would then be lowered down along the legs until it is submerged. A drilling barge would then be floated over the submerged jackup leveling barge and would be flooded so that it comes to rest on the jackup leveling barge.

The above described technique would have the disadvantage of requiring substantially all of the weight of both the jackup levelling barge and the drilling barge to be supported on the jackup legs. In many instances the underlying earth will not provide sufficient bearing resistance to support the loads imposed through the legs except at depths which are for beyond their practical length. Also, the raising of the jackup barge and the ballasting to drive the legs down into the underlying soil could create unstable and potentially dangerous conditions.

SUMMARY OF THE INVENTION

This invention will serve to provide stable and reliable support for shallow water drilling barges in shallow water locations where the bearing capacity of the underlying soil is small. Moreover this support would be obtained safely and economically without need for the fabrication of a special bed on the water bottom and without the need for excessively long jackup legs.

According to the present invention there would be provided a submersible jackup platform which is floated to and positioned at the drilling site and which would support the drilling barge. However, in the present invention the jackup platform would be supported not by the jackup legs alone but rather by a combination of buoyancy, underlying soil support and jackup leg support.

In its more general aspects the present invention would be carried out by floating a submersible platform having jacking legs and jacking mechanisms to a drilling location, ballasting the platform, for example, by flooding, until it rests on the bottom, floating a shallow water drilling barge into position over the submerged platform and flooding the barge so that it comes to rest on the platform. The total weight of the flooded platform and barge would be so related to the bottom surface area of the platform that the pressure exerted by the platform on the water bed is less than the supporting capability of the water bed. At this point the legs would be jacked down into the underlying soil to provide additional bearing capacity. Thereafter, as drilling progresses, and the "hook load" increases, this additional weight will automatically be borne by the jacking legs so that the bearing capacity of the soil will not be exceeded.

In the preferred manner of carrying out the invention the submersible platform would be in the form of a drydock having a pair of hollow wing walls along opposite sides of a central horizontal platform. The wing walls would extend up above the surface of the water even when the platform is resting on the bottom. This will allow the buoyancy of the submerged platform to be controlled so that the total weight of the platform and barge combination will not exceed the supporting capability of the underlying soil.

There has thus been outlined rather broadly the more general features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangments for carrying out the purposes of this invention. It is important, therefore, that this disclosure be regarded as including such equivalent arrangements as do not depart from the spirit and scope of the invention.

BRIEF DESCRIPTION OF THE DRAWINGS

The invention as above explained is described hereinafter in connection with the preferred embodiment shown in the accompanying drawings forming a part of the specification in which:

FIG. 6 is a fragmentary perspective view showing a jacking leg mounting arrangement forming part of the jackup drydock of FIG. 3;

The shallow water drilling barge shown herein has been built but is not new and is not claimed herein per re. The jackup drydock per se and in combination with the shallow water drilling barge are described in a copending U.S. patent application Ser. No. 349,459 filed Feb. 17, 1982, now U.S. Pat. No. 4,456,404. The jackup drydock shown and described therein has not yet been built.

DETAILED DESCRIPTION OF THE PREFERRED EMBODIMENT

Figure 1:
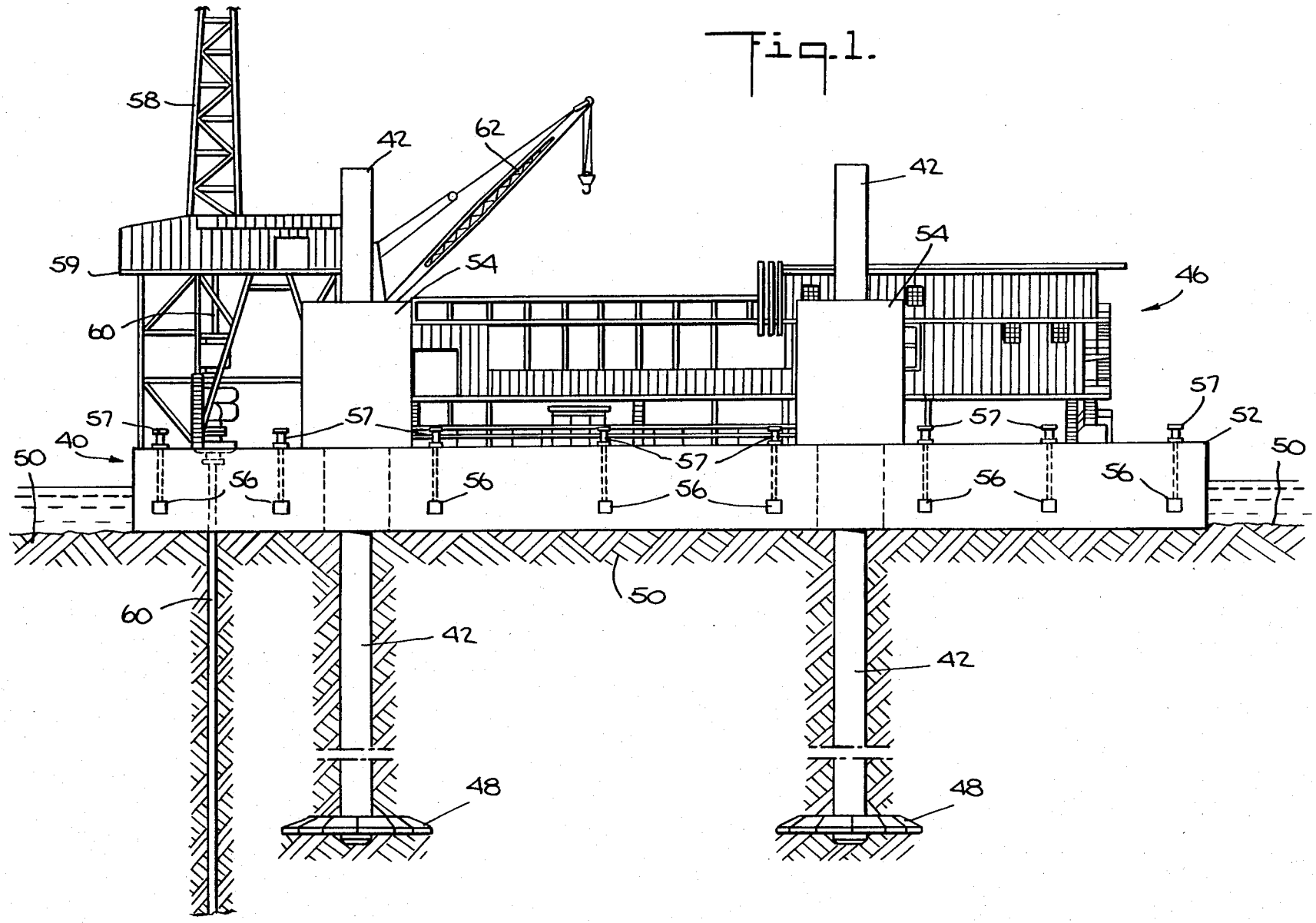
FIG. 1 is a side elevation view of a drilling barge and jackup platform for carrying out the present invention.

The jackup platform and drilling barge shown in FIG. 1 comprise a jackup drydock 40 resting on a shallow water bed 50 and carrying thereon a shallow water drilling barge 46. The jackup drydock 40 is provided with jacking legs 42 having pods 48 at their lower ends. The legs 42 extend down through the soil under the jackup drydock to a depth where the earth provides adequate bearing support for the legs. The jacking legs 42 extend up from the pods 48 to the jackup drydock 40 where they pass through wing walls 52 on the jackup drydock. The jacking legs continue on up through jacking towers 54 mounted on top of the wing walls. Jacking mechanisms (shown and described hereinafter) are provided in the jacking towers 54 to raise and lower the jacking legs 42 relative to the wing walls 52; and, when the jackup drydock is resting on the water bed the jacking mechanisms drive the legs 42 down into the underlying earth and thereafter raise them again when the jackup drydock is to be moved. The wing walls 52 are of hollow construction and they have variable buoyancy. This buoyancy is controlled by allowing water to flow in and out of compartments formed by bulkheads 55 inside the wing walls. Sea chest valves 56 are provided at various locations along the lower edge of the wing walls to admit water into the compartments and to drain water out from them. Sea chest valve operators 57 extend from the sea chest valves up to the deck to control the operation of the valves 56. By so controlling the wing wall buoyancy, the jackup drydock can be partially submerged to rest on the water bed 50.

As shown in FIG. 1, the shallow water drilling barge 46 includes a drilling mast 58 extending up from an elevated drilling platform 59 at one end of the barge. A casing 60 extends down from the mast and through the drilling platform and the jackup drydock to the water bed 50. The casing accomodates a drill string during drilling operations and a conductor string during production operations. It is the weight of the drill string and conductor string which constitutes the "hookload". Lengths of casing, drill pipe and conductor pipe (not shown) are carried on the barge 46 and are fed to the drilling mast in a manner well know to those in the field of oil well drilling and production. A derrick 62 is also arranged on the drilling barge 46 to place the drill pipe and to move other heavy equipment as needed for operation of the barge.

Figure 2:
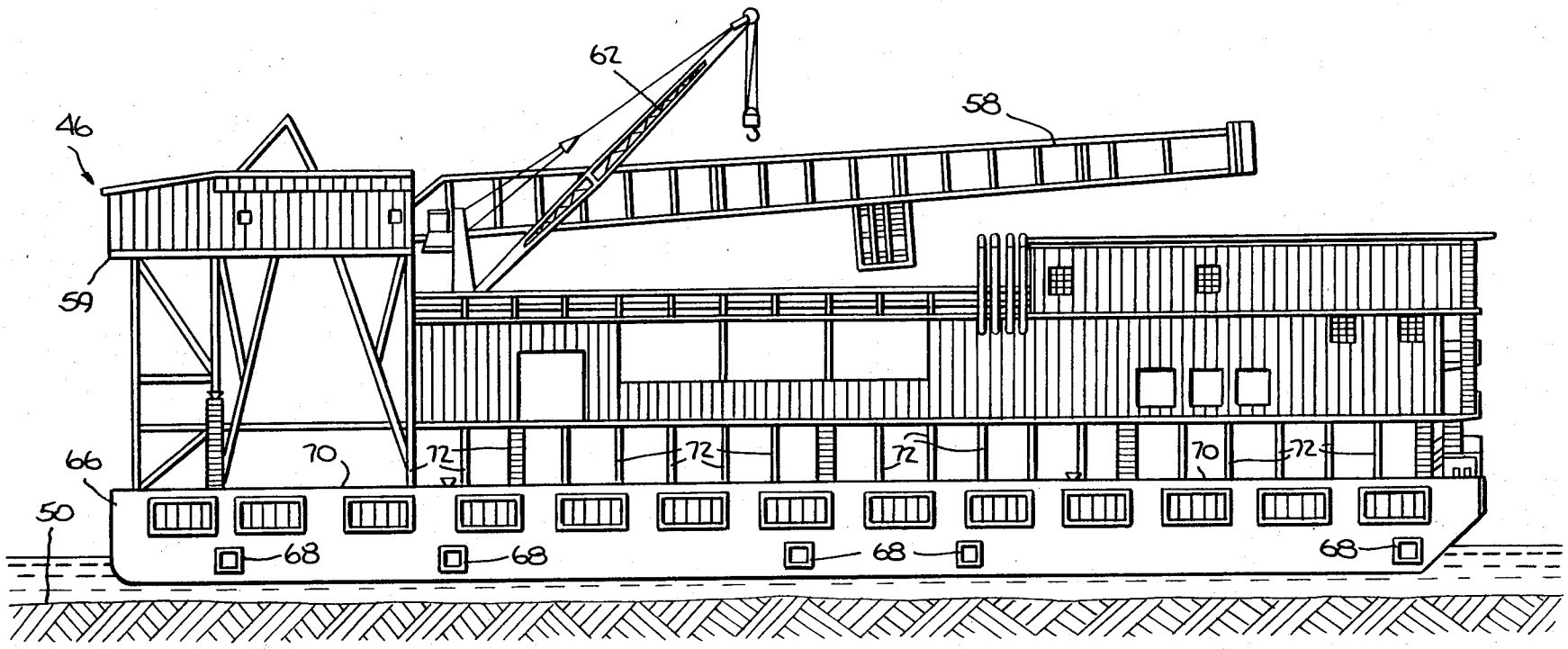
FIG. 2 is a side elevation view of the drilling barge shown in FIG. 1.

As shown in FIG. 2 the drilling barge 46 itself has a flotatable hull 66 which is provided with sea chest valves 68 to admit and to drain sea water. The hull 66 has a shallow draft which permits the barge to be floated to desired drilling locations in shallow water and then to be settled down on the bottom for carrying out drilling operations. Such use of shallow water drilling barges is well known and the drilling barge by itself does not constitute the present invention. The drilling barge 146 has a main deck 70 which is supported above the hull 66 by "posts" 72. This ensures that when the hull 66 is submerged and resting on the bottom at a shallow water location the deck 70 will be above the water surface. As can be seen in FIG. 2 the mast 58, the derrick 62 and the drilling platform 59 are all mounted above the main deck 70. Also, for ease in transporting the barge 46, the mast 58 may be pivoted back to extend along and above the main deck 70 as shown in FIG. 2.

Figure 3:
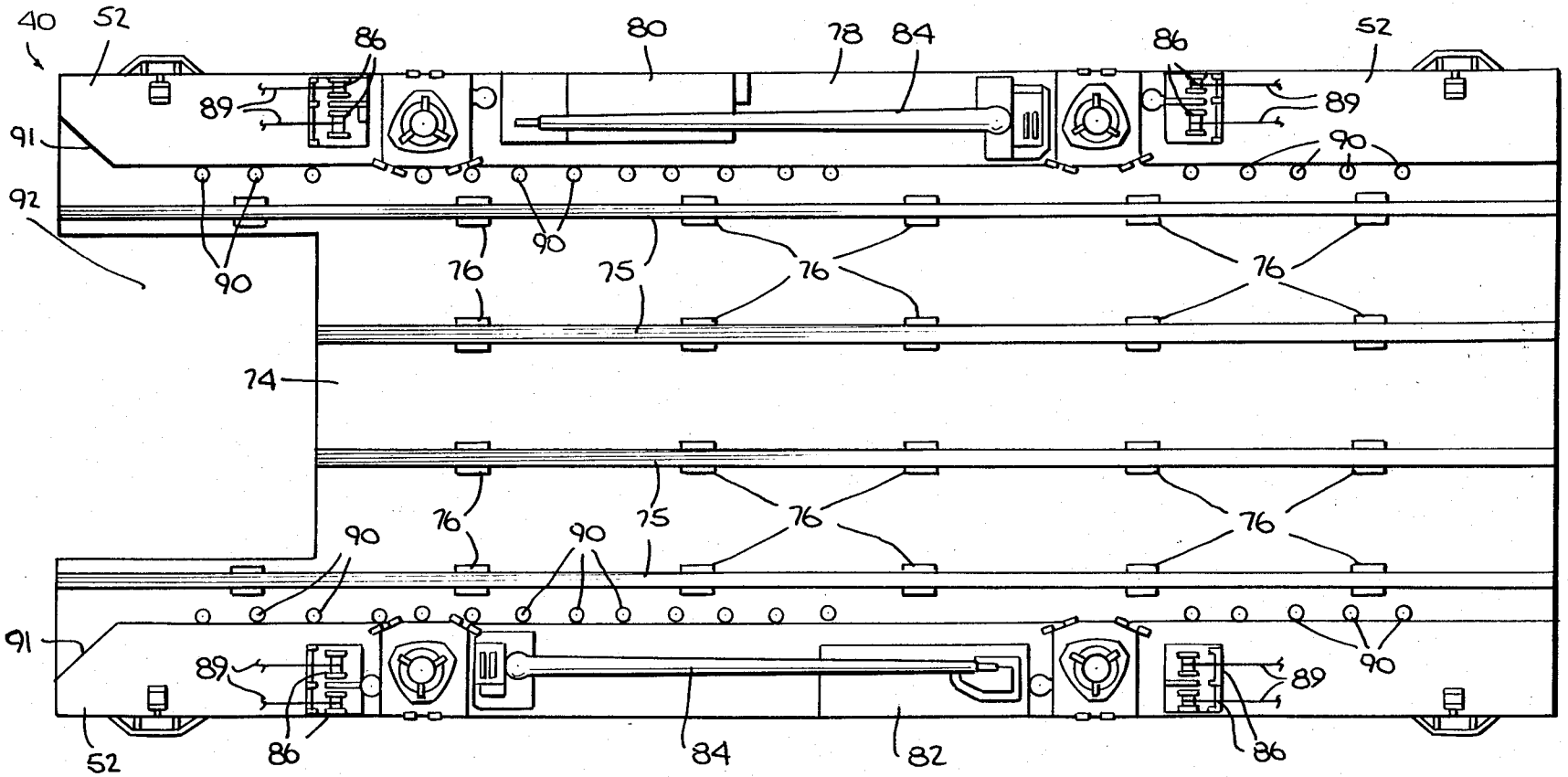
FIG. 3 is a top plan view of a jackup drydock serving as the jackup platform in FIG. 1.

As can be seen in FIG. 3, the wing walls 52 of the jackup drydock 40 are elongated and are arranged parallel to each other in spaced apart relation along opposite sides of a horizontal barge support platform 74. The width and length of the platform 74 is sufficient to allow the shallow water drilling barge 46 to rest on the platform between the wing walls 52.

Elongated support rails 75 extend along the upper surface of the platform 74 spaced apart from each other and parallel to the wing walls 52. These rails each rest on a plurality of roller assemblies 76 which allow the rails to move freely lengthwise of the jackup drydock even when carrying the drilling barge 46 or a production rig.

There are also provided, along the upper surface of one of the wing walls 52, an engine room 78 with an operating room 80 mounted thereon. A crew quarters 82 is provided along the upper surface of the other wing wall. Also, cranes 84 are mounted on each of the wing walls 52 for lifting equipment onto the jackup drydock.

Winches 86 are arranged along the upper surface of the wing wall 52 near each end thereof. These winches pull on cables 90 attached to the drilling barge 46 to position it over the platform 74.

A plurality of fenders 90 are arranged along the inner surfaces of the wing walls to assist in guiding the drilling barge 46 or production rig into place between the wing walls. Also, the wing walls are flared out, as shown at 91, at one end of the jackup drydock to facilitate the entry of the drilling barge into place.

At the end of the platform 74 over which the drilling mast 59 of the shallow water drilling barge 46 is to be positioned there is formed a working slot or opening 92 which accomodates the casing 60 when the jackup drydock is drilling position.

Figure 4:
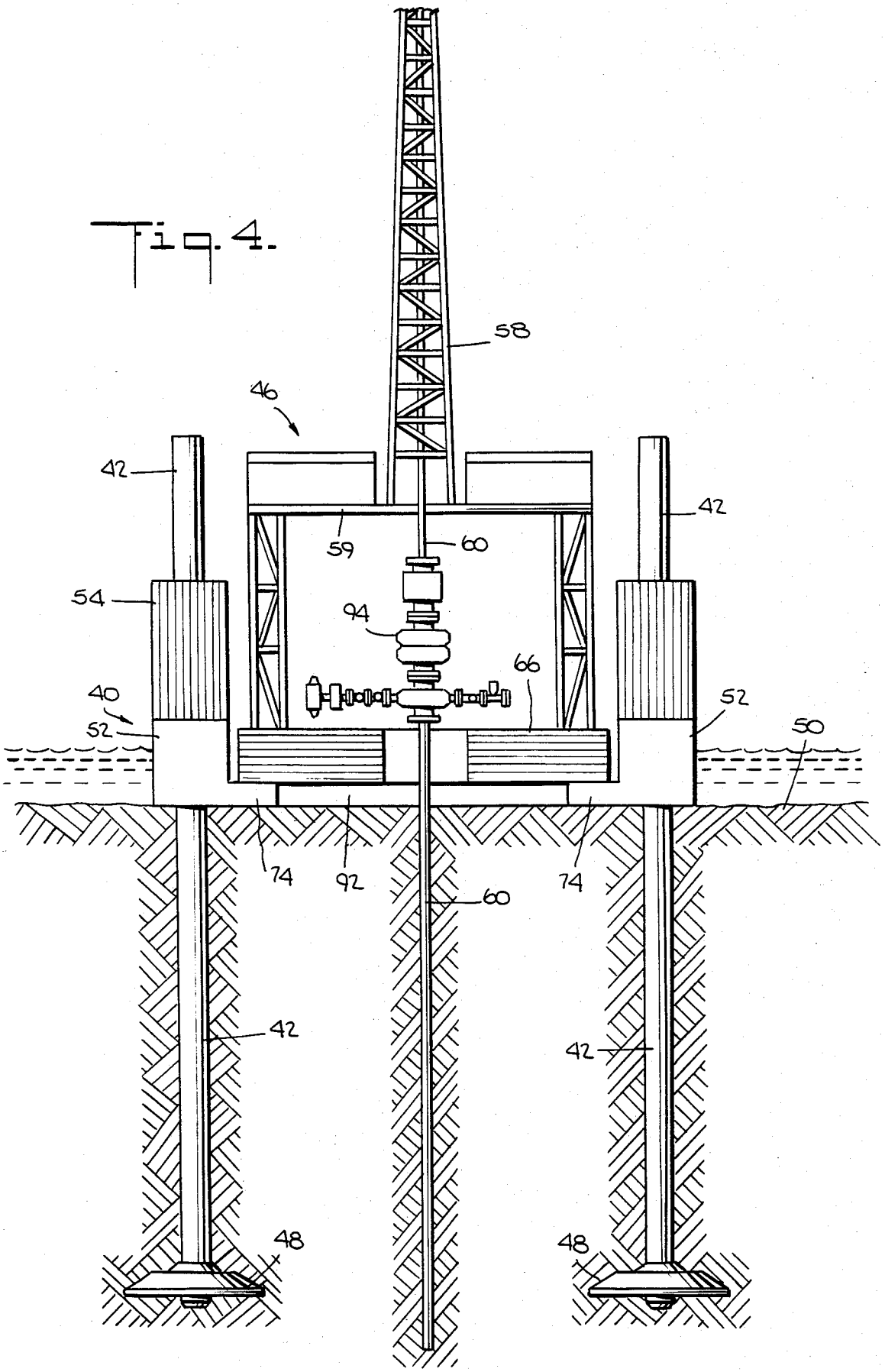
FIG. 4 is an end view taken along line 4—4 of FIG. 1.

Turning now to FIG. 4 it will be seen that for the drilling operation a blowout preventer 94, well known in the art, is mounted on top of the casing 60 to seal off the casing in the event that an upward surge of oil and gas should occur. During the drilling operation the jackup drydock rests on the water bed 50 while the drilling barge 46 rests on the platform 74 of the jackup drydock; and the drill string 60 extends down from the drilling platform 59 on the drilling barge, and through the blowout preventer 94 and, finally, down through the working slot 92 in the jackup drydock into the underlying earth below the water bed 50. Also, the jackup legs 42 are extended downwardly from the jackup drydock so that the pods 48 are submerged in the underlying soil at a depth where the soil has sufficient strength to ensure that the jackup drydock and the drilling barge along with the drill string will be stably supported. In this condition the jackup drydock and the drilling barge are supported by a combination of three effects, namely their own partial buoyancy, the support of the underlying soil forming the water bed 50 and the support of the soil acting on the pods 48.

Figure 5:
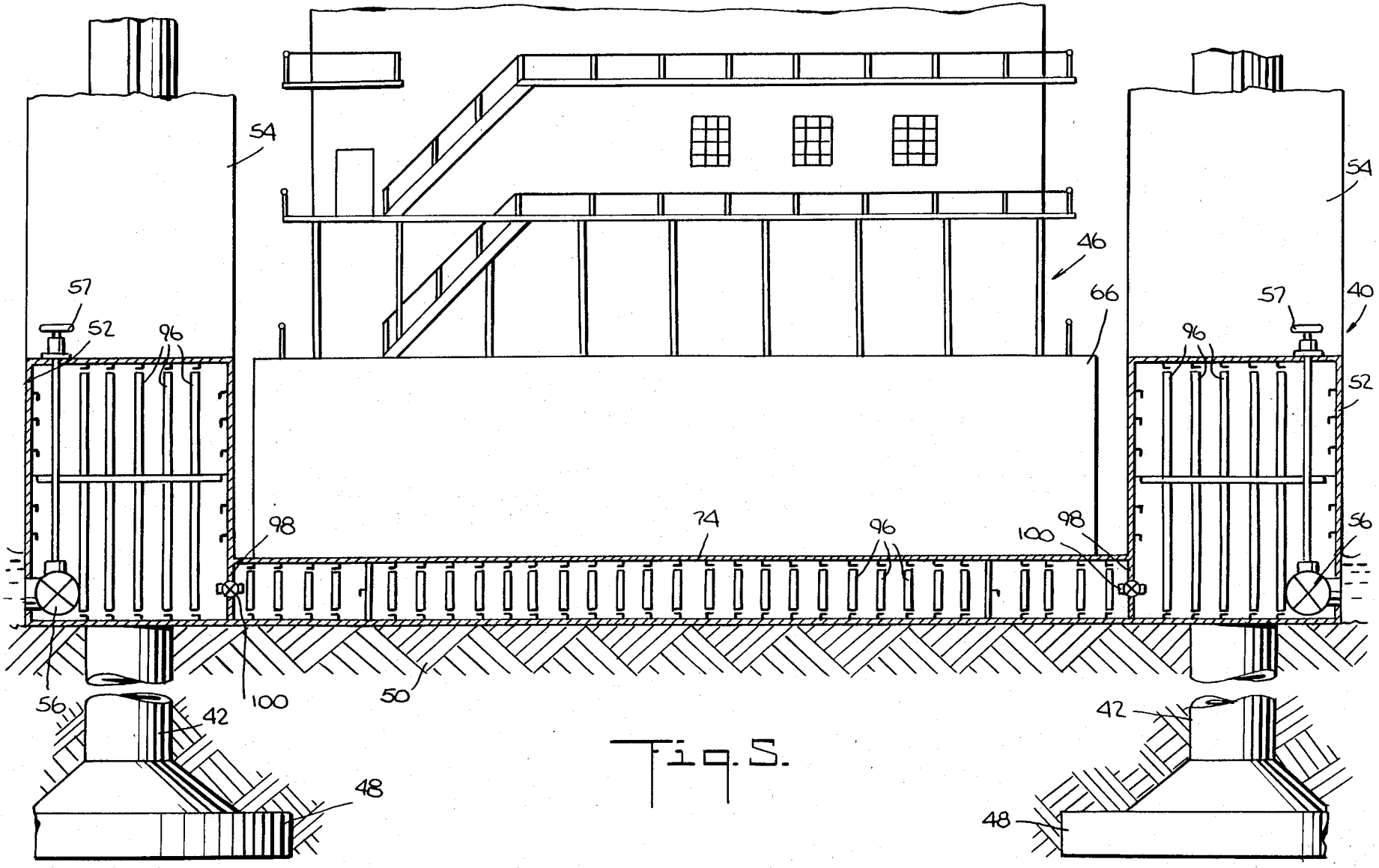
FIG. 5 is a view, partially in section, taken along line 5—5 of FIG. 1.

As shown in FIG. 5, the barge support platform 74 of the jackup drydock 40 interconnects the wing walls 52 along their lower edges. Both the wing walls 52 and the barge support platform 74 are of hollow constructon and they are provided with internal stiffeners 96 to maintain their strength and rigidity. By virtue of this construction the barge support platform 74 may also be of variable buoyancy. Internal bulkheads 98 and valves 100 are also provided inside the wing walls and the platform to control the flow of water between them. This permits selective ballasting of different portions of the jackup drydock.

It will be noted from FIG. 5 that the wing walls 52 have substantial freeboard, i.e. vertical height above the sea surface 44, in the normal floating position of the jackup drydock. The barge support platform 74, however, has little or no freeboard. Thus the wing walls are not completely submerged when the jackup drydock rests on the water bed 50. This enables the ballast and buoyancy of the jackup drydock to be controlled while it rests on the water bed.

FIGS. 6–9 show the construction and arrangement of the jacking legs 42 and the manner in which they are mounted in the wing walls 52.

Figure 8:
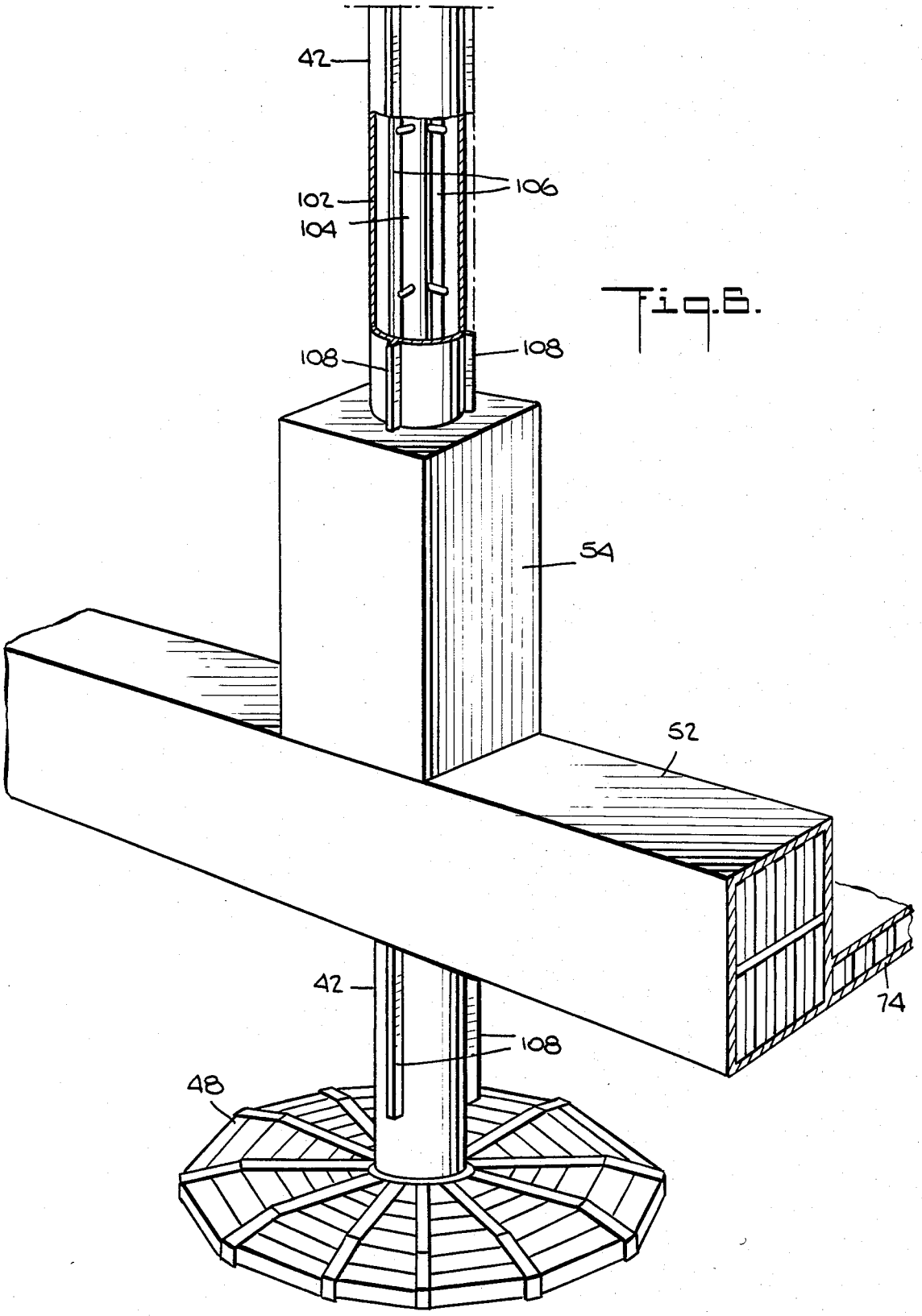
FIG. 8 is a section view taken along along line 8—8 of FIG. 7.
Figure 9:
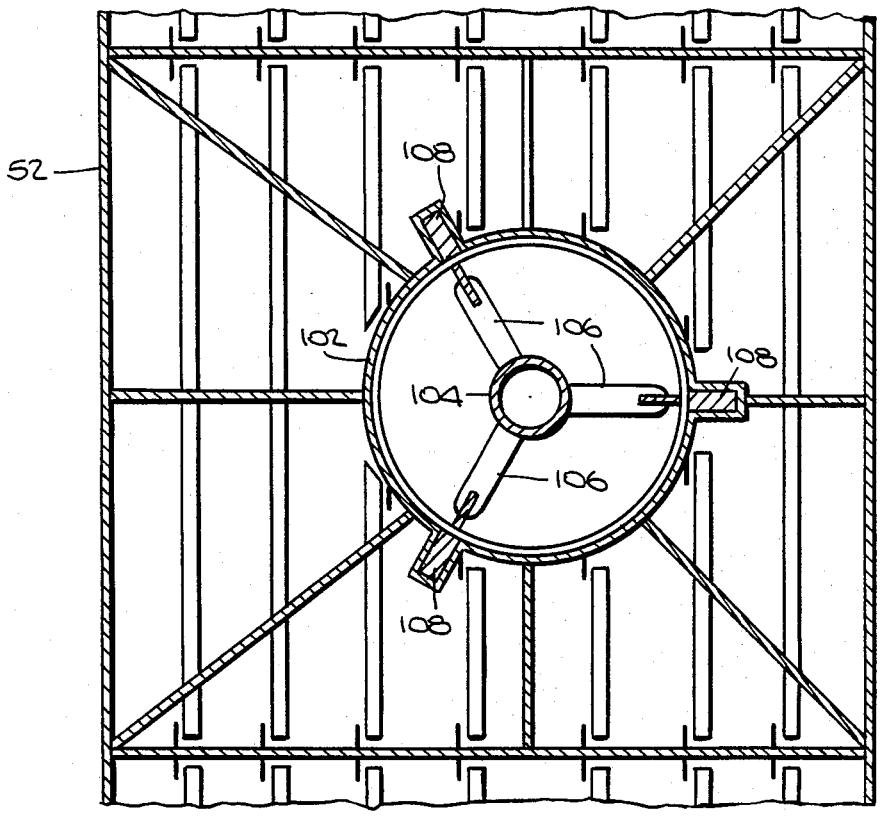
FIG. 9 is a section view taken along line 9—9 of FIG. 7.

As can be seen in FIGS. 6, 8 and 9, the jacking legs 42 are of cylindrical configuration and they comprise an outer cylindrical wall 102, an inner axial wall 104 and three equispaced radial ribs 106. Along the outside of the cylindrical wall 102, in line with the radial ribs 106, there are provided gear racks 108.

Figure 7:
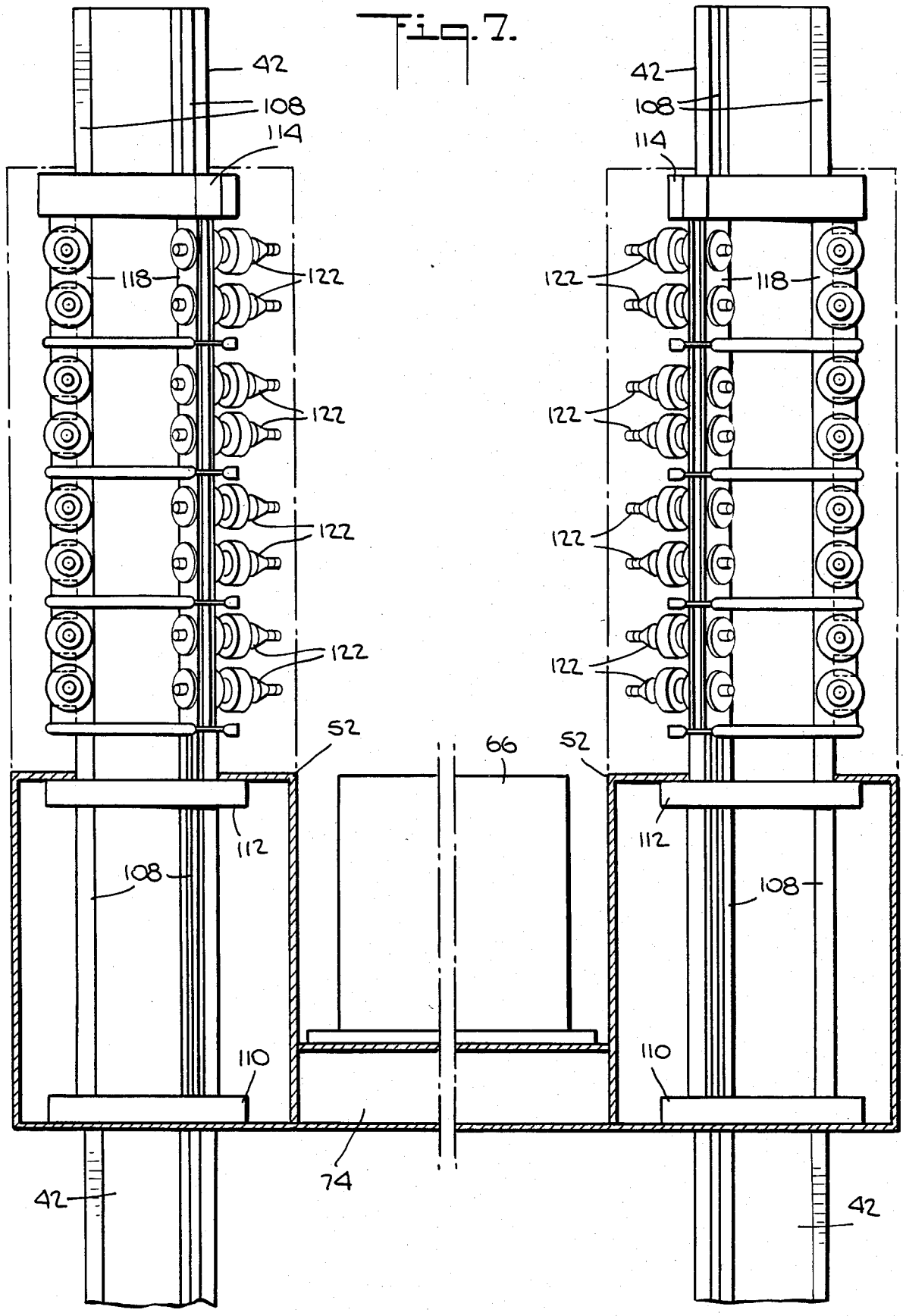
FIG. 7 is an enlarged section view taken along line 7—7 of FIG. 1.
Figure 8:
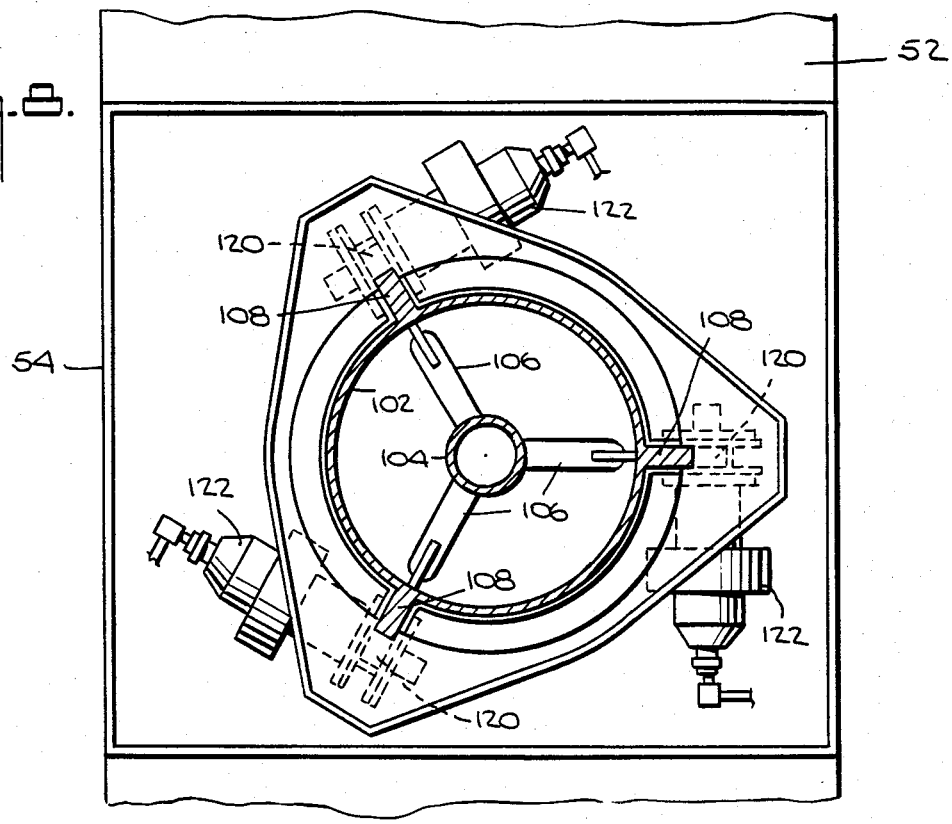

Turning now to FIG. 7 it will be seen that there are provided jackup leg guides 110, 112 and 114 mounted respectively on the floor and the upper surface of the wing walls 52 and at the top of the jack housing 54. As shown in FIGS. 8 and 9, the guides closely accomodate the outer surface of the legs 42 and they are provided with recess formations 116 to accomodate the gear racks 108.

Inside the jack housings 54 there are provided pairs of elongated gear support plates 118 which extend between the guides 112 and 114. Each pair of support plates straddles one of the leg gear racks 108. The support plates 118 also serve to mount pinion gears 120 (FIG. 8) which are meshed with the gear racks 108. Hydraulic drive motors 122 are also mounted on the support plates 118 and are connected to drive the pinion gears. The general construction of the gear rack, pinion and hydraulic drive motors arrangement is well known and is available, for example, from Superior Lift-Boat and Rig Mfg. Inc., Route 3, Box 555, AB Lafayette, La. 70505. Accordingly the details of the construction of these items will not be described herein, suffice it to say that the motors 122 for each jacking leg 42 are driven in unison to turn the pinions in one direction or another to move the jacking leg up or down relative to the jackup drydock 40 or, conversely, to move the jackup drydock down or up relative to the leg. The motors 122 can be independently controlled from leg to leg so that substantially all of the weight of the jackup drydock will be imposed on each leg individually to drive it deeply into the earth below the water bed 50. Other jacking arrangements, using leg gripping devices and hydraulic or pneumatic piston and cylinder arrangements, which are well known in the art, may also be used.

The exact dimensions of the jackup drydock are not critical to the present invention. Nevertheless, the basic dimensions of an illustrative arrangement are given below:

| | |
|---|---|
| Overall length | 230 ft. (70.1 m) |
| Overall width | 98 ft. (29.9 m) |
| Height of wing walls | 18 ft. (5.5 m) |
| Width of wing walls | 14 ft. (4.3 m) |
| Width of platform | 70 ft. (21.3 m) |
| Height of platform | 4 ft. (1.2 m) |
| Width of working opening | 50 ft. (15.2 m) |
| Length of working opening | 40 ft. (12.2 m) |
| Distance between centers of jacking legs | 104 ft. (31.7 m) |
| Distance of center of jacking legs closest to working slot end to end | 56 ft. (17.1 m) |
| Diameter of jacking legs | 6 ft. (1.8 m) |
| Length of jacking legs | 125 ft. (38.1 m) |

Figure 10:
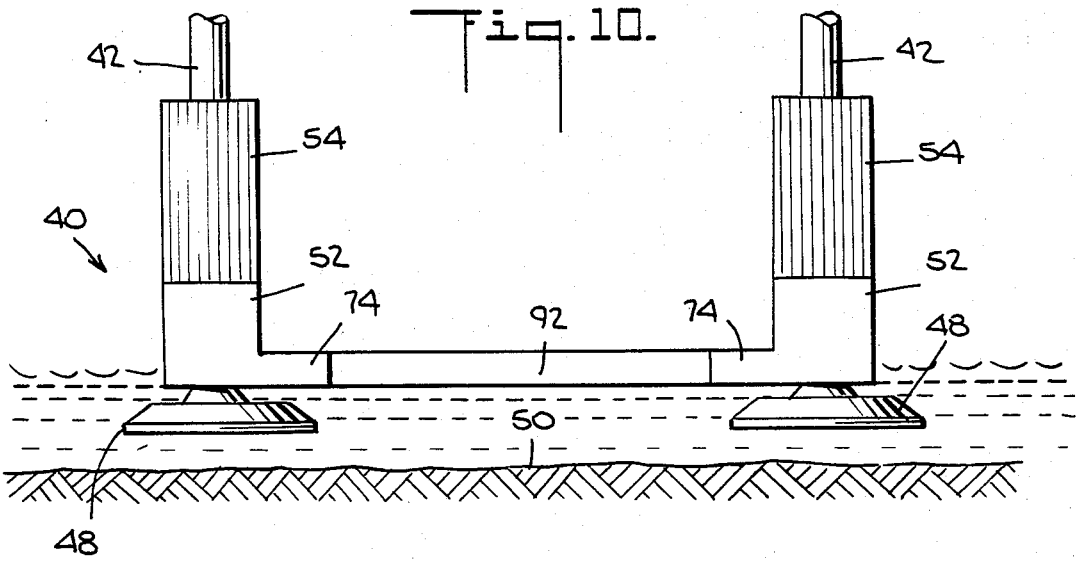
FIG. 10 is a view similar to FIG. 4 but showing the floating of the jackup drydock to a drilling location.

FIGS. 10–14 show the proposed use of the jackup drydock 40 to support the drilling barge 46 in a shallow water location. As shown in FIG. 10 the jackup drydock is floated, with its legs 42 in their fully raised position, to a drilling site. This site is characterized by a shallow water depth, e.g. 8–16 feet (2.4–4.8 meters). The depth must be sufficient to permit the jackup drydock to be floated with the pods 48 on the bottoms of the legs 42 clear of the water bed 50 and to allow the drilling barge 46 to be floated onto the platform 74 when the jackup drydock rests on the bottom. Also, the depth of the water should not be so great that its surface is above the wing walls 52 of the jackup drydock 40 when it is resting on the water bed 50. In an illustrative example the water depth will be about twelve feet (3.6 meters).

Figure 11:
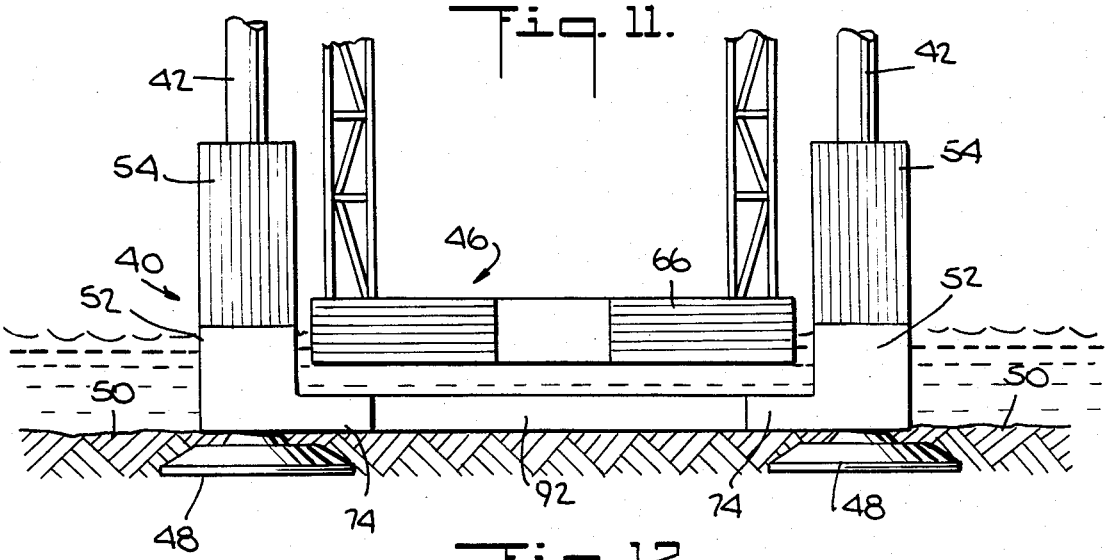
FIG. 11 is a view similar to FIG. 10 but showing the settlement of the jackup drydock on the water bottom and the floating of a drilling barge into position over the jackup drydock.

When the jackup drydock 40 is floated to the proper location its sea chest valves 56 (FIGS. 1 and 5) will be opened to flood and supply ballast to the platform 74 and the wing walls 52. The platform will then become partially submerged and brought to rest on the water bed 50 as shown in FIG. 11. At this time the drilling barge 46 will be floated into position between the wing walls 52 and over the platform 74 as shown.

Figure 12:
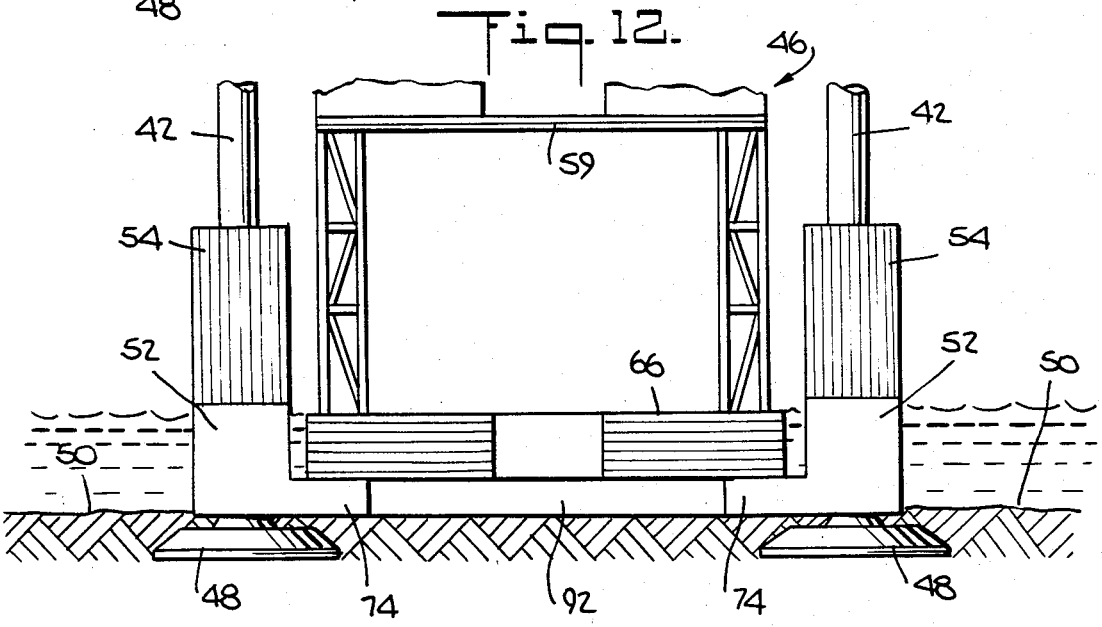
FIG. 12 is a view similar to FIG. 11 but showing the drilling barge flooded and resting on the jackup drydock.

When the drilling barge 46 has been brought to proper position between the wing walls 52, its sea chest valves 68 will be opened to flood the hull of the barge and allow it to sink down until it comes to rest on the platform 74 of the jackup drydock as shown in FIG. 12.

At this point the combined weight of the submerged jackup drydock 40 and the drilling barge 46 will be supported by the buoyant effects of the surrounding water as well as by the underlying soil of the water bed 50. In an illustrative example the combined basic weight of the jackup drydock 40 and the drilling barge 46 would be 7,400 k (k=1,000 pounds) or 3,357 mkg. (mkg=1,000 kilograms) but with fuel and supplies this might be as much as 11,650 k (5,284 mkg). In addition, in flooding, the jackup drydock 40 and barge 46 would take on an additional 7,000 k (3,175 mkg) of ballast for a total downward force of 18,650 k (8,459 mkg). The combined buoyancy of the jackup drydock 40 and barge 46 in twelve feet (3.6 m) of water is 14,686 k (6,662 mkg). The net downward force on the underlying soil would be 3,964 k (1,797 mkg) or about 4,000 k (1,814 mkg).

Now in the proposed example the jackup drydock would have a bottom bearing area of about 20,540 $ft^2$ (1,908 $m^2$); and, allowing for about 20% erosion of the underlying soil, the bottom of the jackup drydock would have about 16,600 $ft^2$ (1,542 $m^2$) of effective bearing area to support the 4,000 k (1,542 mkg) load. This amounts to a pressure on the underlying soil of about 0.25 k per $ft^2$ (1.220 mkg per $m^2$).

If the underlying soil has a strength of 0.8 k per $ft^2$ (3.904 mkg per $m^2$) the pressure of the jackup drydock and barge on the soil will be well below that which would allow a factor of safety of two; and the underlying soil will therefore support the jackup drydock and barge.

Now, during drilling operations the drill string will extend downward from the working slot 92 at the stern end of the jackup drydock; and as this drill string lengthens its weight, which is known as "hook load", will add significantly to the total downward force of the jackup drydock and drilling barge. In the example chosen this hook load may be expected to be about 1,500 k (680 mkg).

Also, since the hook load is concentrated at the stern end of the jackup drydock its effect will be imposed on the underlying soil via the rearwardmost 3,000 $ft^2$ (279 $m^2$) of the jackup drydock bottom surface area; and, when a 20% erosion factor is considered, this additional hook load must be considered to be applied to the soil supporting about 2,400 $ft^2$ of (221 $m^2$) the jackup drydock. The hook load therefore would amount to an increase in downward force of about 0.63 k per $ft^2$ (3.074 mkg per $m^2$) which, when added to the force produced by the jackup drydock and barge without the hook load (i.e. 0.25 k per $ft^2$), (1.220 mkg per $m^2$) would amount to 0.88 k per $ft^2$ (4.294 mkg per $m^2$) which is far in excess of the total permissible load of 0.4 k per $ft^2$ (1.952 mkg per $m^2$).

Figure 13:
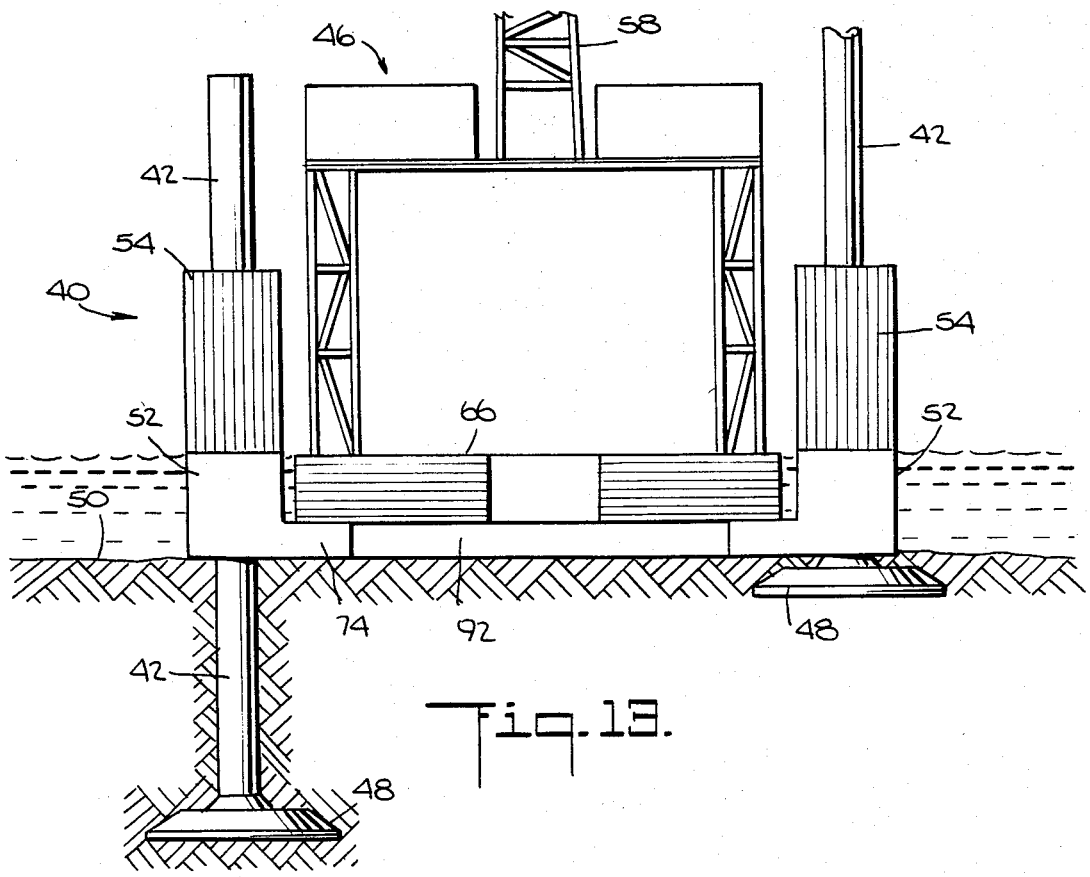
FIG. 13 is a view similar to FIG. 12 but showing one leg of the jackup drydock jacked down and penetrating the underlying soil.
Figure 14:
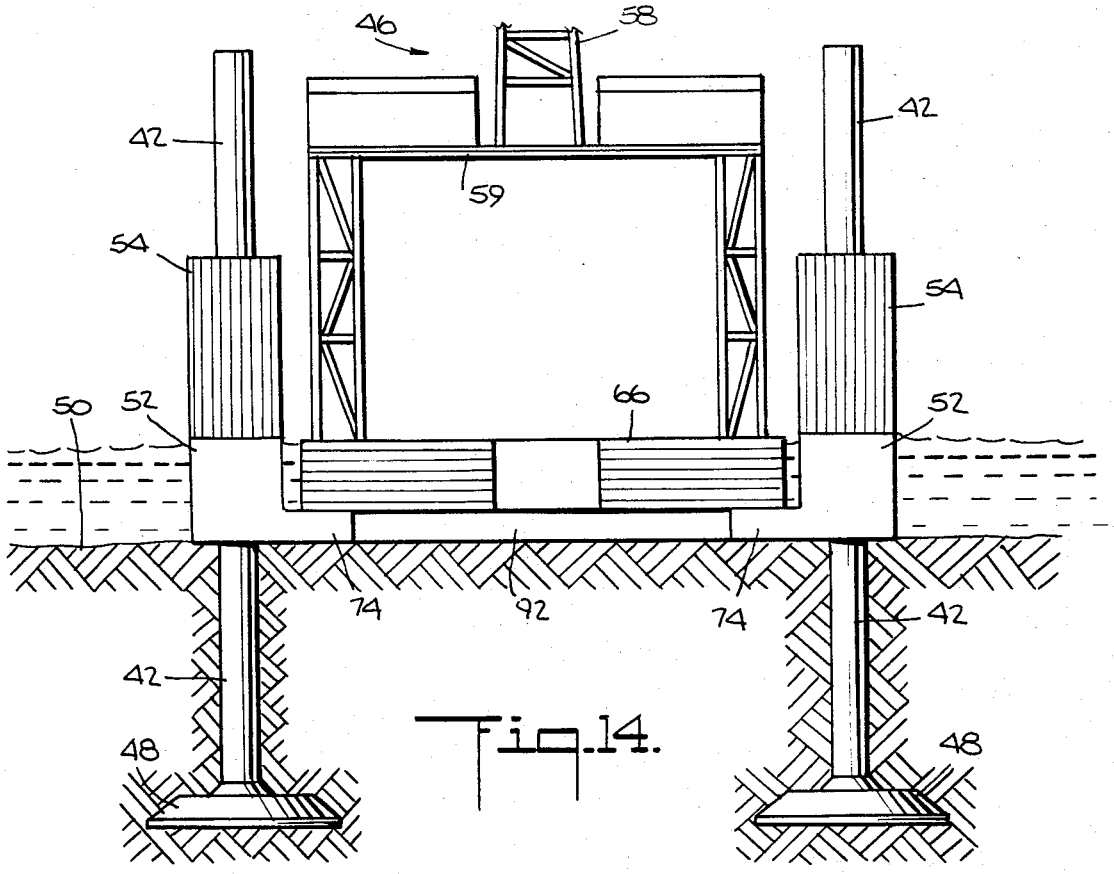
FIG. 14 is a view similar to FIG. 13 and showing two legs of the jackup drydock jacked down and penetrating the underlying soil.

This hook load would be accomodated according to the present invention by jacking down the legs 42 as shown in FIGS. 13 and 14 to bring the pods 48 down into a region of the underlying soil which is more consolidated and therefore is more capable of supporting a load than the soil at the surface of the water bed.

The amount of additional load which can be carried by the submerged legs 42 increases with the depth to which they are jacked. This is because at greater depths the soil is more firmly consolidated and is therefore more capable of supporting downwardly applied loads. In the example given above, the excess of hook load i.e. 0.88 k per $ft^2$ would be well in excess of the total permissible load of 0.4 k per $ft^2$ (1.952 mkg per $m^2$). This excess load, which is spread over 2,400 $ft^2$ (221 $m^2$) amounts to 1,152 k (0.522 mkg). Half of this load, i.e. 576 k (261 mkg), is to be taken up by each of the stern end legs 42. In the example given, the pod 48 at the bottom of each leg is thirty feet (9.14 m) in diameter and has a surface area of 700 $ft^2$ (65 $m^2$). At a depth of forty feet (12.19 m) the underlying soil will apply to each pod an additional support capability of 1,089 k (0.494 mkg). This provides an acceptable factor of safety of 1.9.

The stern end legs 42 would be jacked down as shown in FIGS. 13 and 14 prior to imposition of the hook load. The action of this jacking would impose an uplift reaction on the jackup drydock and this uplift reaction would be as great as the additional support capability acquired by the driver leg. Thus the upward reactions force produced by jacking down each leg would be about 1,089 k (0.494 mkg). This, however, would be far less than the 4,000 k net downward force of the jackup drydock and barge combination. Thus it will be seen that the legs can be driven down into the underlying soil without lifting the jackup drydock up off the soil. Accordingly, the assembly will be firmly and securely supported throughout the entire jacking operation.

It will be appreciated that the forward end legs 42 could be jacked down in the same manner to provide support at that end of the jackup drydock. Also the legs may be jacked down in anticipation of further erosion of the underlying soil so that as the soil is washed away, e.g. by river currents, the weight of the jackup drydock and barge will be automatically transferred to the submerged legs 42.

Once the legs 42 are driven down into the underlying soil they would also provide a certain amount of resistance to uplift loads. Thus, as each leg is driven down it would automatically provide additional uplift resistance which would enable the other legs to be driven down with even greater force to deeper locations to provide increased support capability. Further, this uplift resistance would serve to stabilize the jacking drydock and barge against the effects of winds and waves.

It will also be appreciated that as drilling continues and the hook load increases, the legs 42 may be jacked down even further into the underlying soil to provide even greater support to the jackup drydock. The added weight of the drill string would provide uplift resistance which allows this further jacking down of the legs without lifting the jackup drydock up off the underlying soil. After drilling operation have been completed the drilling barge 46 may be disconnected from the well it has drilled and then it may be deballasted and floated away from the jackup drydock 46.

The jackup drydock 46 may then be deballasted to assist in jacking up its legs 42. Also to assist in raising the legs they may be provided with a water jetting arrangement which is well known in the art. Once the legs 42 have been raised the jackup drydock is then full deballasted and floated away to a new location.

I claim:

1. A method of supporting a drilling barge for conducting drilling operations at a location characterized by a shallow water depth and a silty water bed of low load bearing capacity, said method comprising the steps of (a) floating a submersible platform, having jacking legs and jacking mechanisms thereon, to said location;

(b) ballasting said submersible platform until it rests on said water bed;

(c) floating a drilling barge into position over the submerged platform and flooding the barge so that it comes to rest on the platform, the total weight of the platform and barge being so related to their buoyancy and to the bottom surface area of the platform that the pressure exerted by the platform on the water bed is less than the supporting capability of the water bed, and (d) jacking the legs of the platform down into the water bed to a depth where the soil provides increased bearing capacity.

2. A method according to claim 1 wherein each leg is jacked down separately.

3. A method according to claim 2 wherein each leg is jacked down with a force less than that which will lift the platform off the water bed.

4. A method according to claim 3 wherein a hook load is applied to said platform by adding drilling pipe to extend down from the drilling barge.

5. A method according to claim 4 wherein after application of said hook load, said support legs are jacked further down into the underlying soil.

6. A method according to claim 1 wherein the submersible platform is ballasted by flooding.

7. A method according to claim 1 or 6 wherein the submersible platform is provided with hollow wing walls which extend along each side of the platform and upwardly therefrom and wherein said ballasting is carried out by flooding said wing walls.

8. A method according to claim 7 wherein said wing walls are higher than the water depth.

* * * * *

UNITED STATES PATENT AND TRADEMARK OFFICE

CERTIFICATE OF CORRECTION

PATENT NO. : 4,505,615

DATED : March 19, 1985

INVENTOR(S) : Darrell L. Evans

It is certified that error appears in the above-identified patent and that said Letters Patent is hereby corrected as shown below:

Title page:

[57] ABSTRACT, line 9, "floating" to read -- flooding --.

Signed and Sealed this

*Third* Day of *December 1985*

[SEAL]

*Attest:*

DONALD J. QUIGG

*Attesting Officer*

*Commissioner of Patents and Trademarks*